US009149819B1

(12) United States Patent
Bennett

(10) Patent No.: US 9,149,819 B1
(45) Date of Patent: Oct. 6, 2015

(54) LAWN SPRINKLER

(71) Applicant: Lewis Peter Bennett, Shaker Heights, OH (US)

(72) Inventor: Lewis Peter Bennett, Shaker Heights, OH (US)

( * ) Notice: Subject to any disclaimer, the term of this patent is extended or adjusted under 35 U.S.C. 154(b) by 98 days.

(21) Appl. No.: 13/917,331

(22) Filed: Jun. 13, 2013

Related U.S. Application Data

(60) Provisional application No. 61/664,346, filed on Jun. 26, 2012.

(51) Int. Cl.
*B05B 3/08* (2006.01)

(52) U.S. Cl.
CPC ..... *B05B 3/08* (2013.01)

(58) Field of Classification Search
CPC ..... B05B 3/08
USPC ..... 239/200–210, 232, 236, 221.5, 223
See application file for complete search history.

(56) References Cited

U.S. PATENT DOCUMENTS

| | | | | | |
|---|---|---|---|---|---|
| 129,125 | A * | 7/1872 | Gibson | 239/231 |
| 1,938,838 | A * | 12/1933 | Jacobson | 239/236 |
| 3,703,993 | A * | 11/1972 | Schreiner | 239/231 |
| 3,878,990 | A * | 4/1975 | Geraudie | 239/236 |
| 4,637,549 | A * | 1/1987 | Schwartzman | 239/230 |
| 5,704,549 | A * | 1/1998 | Kephart et al. | 239/236 |
| 7,143,957 | B2 * | 12/2006 | Nelson | 239/222.21 |
| 7,173,957 | B2 * | 2/2007 | Shakeri et al. | 375/140 |

* cited by examiner

*Primary Examiner* — Len Tran
*Assistant Examiner* — Joel Zhou
(74) *Attorney, Agent, or Firm* — John D Gugliotta

(57) ABSTRACT

An improved adjustable lawn sprinkler is provided having a counterbalanced nozzle assembly having a nozzle. The nozzle assembly is connected to a rotating mechanism allowing the nozzle to freely rotate. The lawn sprinkler has a guide member for supporting barrier supporters which support barriers to form a user defined shape which corresponds to the irrigation area. The guide member is attached to support structures. The nozzle assembly is in fluid communication with a water transfer member which is in fluid communication with a water inlet member which is further in fluid communication with a fluid source. The instant abstract is neither intended to define the invention disclosed in this specification nor intended to limit the scope of the invention in any way.

9 Claims, 8 Drawing Sheets

LAWN SPRINKLER

RELATED APPLICATIONS

The present application claims the benefit of U.S. Provisional Application Ser. No. 61/664,346, filed on Jun. 26, 2012 and incorporated by reference as if fully rewritten herein.

BACKGROUND OF THE INVENTION

1. Held of the Invention

The present invention relates generally to lawn sprinklers, and, more particularly, to an improved adjustable lawn sprinkler particularly adapted for watering a user-defined area.

2. Description of the Related Art

Many homeowners take great pride in a well-manicured lawn. Although there are many factors involved with keeping a well-manicured lawn, an extremely important factor includes proper lawn irrigation. Many homeowners rely on lawn sprinklers for irrigating their lawns, and there are several different types of lawn sprinklers available to homeowners.

However, the typical lawn sprinkler is designed to irrigate a lawn in an arcuate or semi-arcuate pattern. Since most lawns take on a generally rectangular or square shape, the arcuate or semi-arcuate irrigation pattern becomes a problem and does not efficiently irrigate a homeowner's lawn. If only one lawn sprinkler is used, the lawn sprinkler must be repeatedly transferred to new areas in order to irrigate the entire area of the lawn. Further, since the irrigation pattern is arcuate or semi-arcuate by design, water is likely to be dispersed outside of the rectangular or square shape of the lawn resulting in wasted water. A user can eliminate the problem of transferring a single lawn sprinkler to various areas by utilizing a plurality of lawn sprinklers arranged in an overlapping fashion to cover the entire area of the lawn. Although this removes the need for transferring, this tends to increase the amount of wasted water due to the overlapping, as well as still dispersing water outside of the typical lawn boundary.

A different type of lawn sprinkler, an oscillating-type lawn sprinkler, is designed to irrigate lawns in a rectangular or square shape. These are beneficial when dealing with truly rectangular or square shaped lawns, but require the sprinkler itself to be placed in the middle of the lawn and then removed for mowing. Furthermore oscillating-type lawn sprinklers irrigate in a rectangular pattern, and are strictly limited to dispersing water within that rectangular or square geometry and are not beneficial for irregularly shaped lawn areas.

Other attempts have been made to produce lawn sprinklers with non-circular irrigation patterns, and these attempts usually involve modifying a standard impulse sprinkler. Standard impulse sprinklers have been modified by changing the vertical spray angle while rotating the nozzle of the lawn sprinkler, or by varying the flow rate while the sprinkler rotates, in an attempt to alter the range of the jet. Although a non-circular irrigation pattern is produced, the irrigation pattern tends to be unpredictable and cannot be varied sufficiently to water a square or rectangular area.

What has not yet existed is an improved adjustable lawn sprinkler that can provide an irrigation pattern to an irregularly shaped or rectilinear area of a lawn from a single point outside that lawn, reducing wasted water while applying a uniform amount of water to that specific area of the lawn, and avoiding the need to remove the sprinkler for mowing.

Consequently, a need has been felt for providing an improved adjustable lawn sprinkler particularly adapted for watering a user-defined area from a single location anywhere within or outside that area.

SUMMARY OF THE INVENTION

It is therefore an object of the present invention to provide an improved lawn sprinkler.

It is a feature of the present invention to provide an improved adjustable lawn sprinkler particularly adapted for watering a user-defined area from a single convenient location anywhere within or even outside that area.

It is yet another feature of the present invention to facilitate the irrigation of irregularly shaped areas of a lawn, where the user selects an area to be irrigated and adjusts the lawn sprinkler irrigation pattern to coincide with the selected area.

Briefly described according to one embodiment of the present invention, an improved adjustable lawn sprinkler is provided having a counterbalanced nozzle assembly having a nozzle. The nozzle assembly is connected to a rotating mechanism allowing the nozzle to freely rotate. The lawn sprinkler has a guide member for supporting barriers to form a user defined shape which corresponds to the irrigation area. The guide member is attached to support structures. The nozzle assembly is in fluid communication with a water transfer member which is in fluid communication with a water inlet member which is further in fluid communication with a fluid source.

In accordance with a preferred embodiment, an adjustable lawn sprinkler is provided that can be easily adjusted to irrigate an irregularly shaped area within a lawn.

An advantage of the present invention is that it can be positioned anywhere within or next to a certain area to be irrigated.

Another advantage of the present invention is that it need not be permanently installed but can be easily transferred from one location to a next location if desired.

Yet another advantage of the present invention is that is can be made with a variety of materials or in a variety of color combinations to allow for innovative design.

Further, the present invention can be economically and conveniently manufactured to provide easy irrigation of irregularly shaped areas of a lawn.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
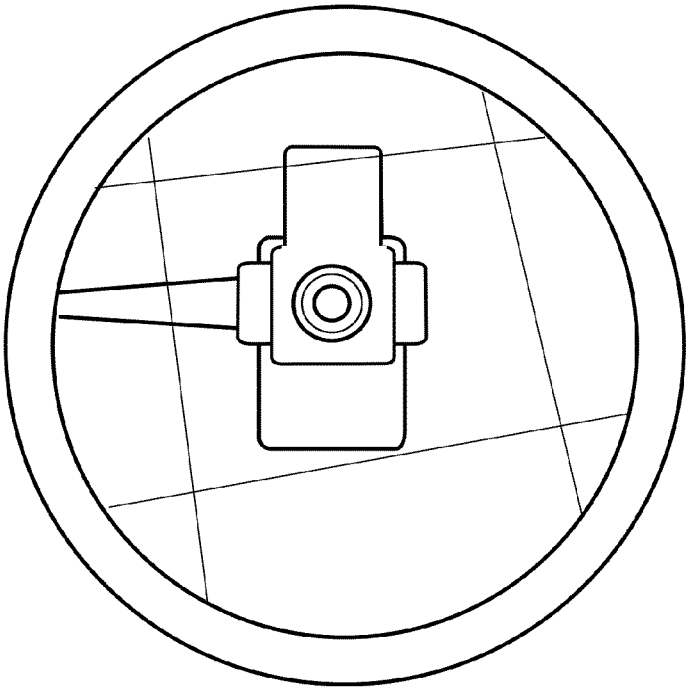
FIG. 1 is a plan view of an improved adjustable lawn sprinkler according to the preferred embodiment of the present invention.
Figure 2:
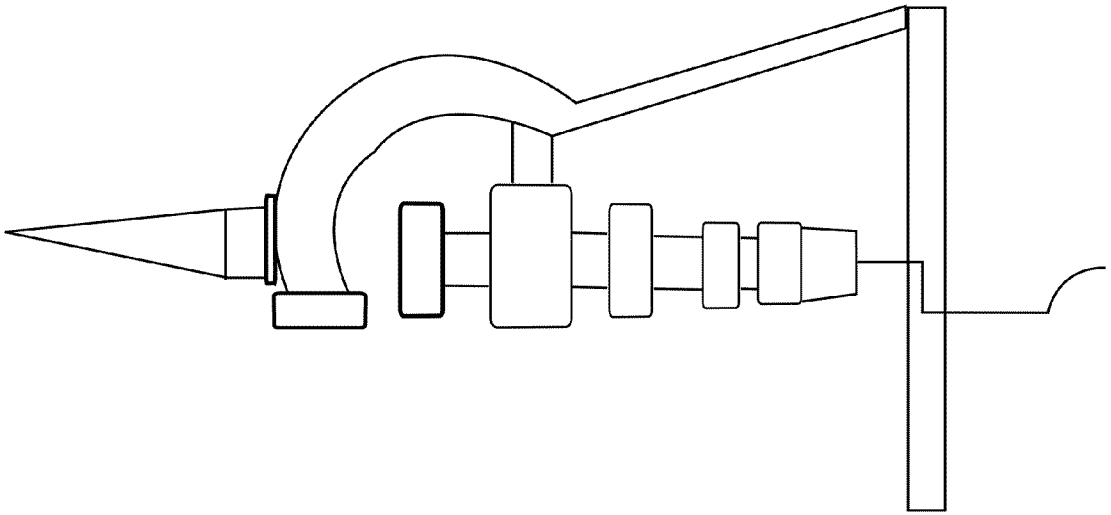
FIG. 2 is a front elevation of an improved adjustable lawn sprinkler according to the preferred embodiment of the present invention.
Figure 3:
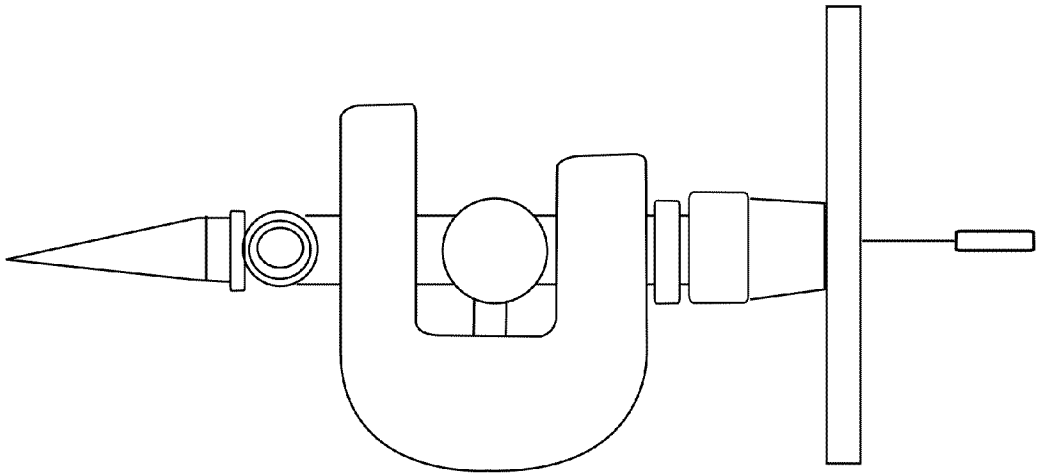
FIG. 3 is a side elevation of an improved adjustable lawn sprinkler according to the preferred embodiment of the present invention.
Figure 4:
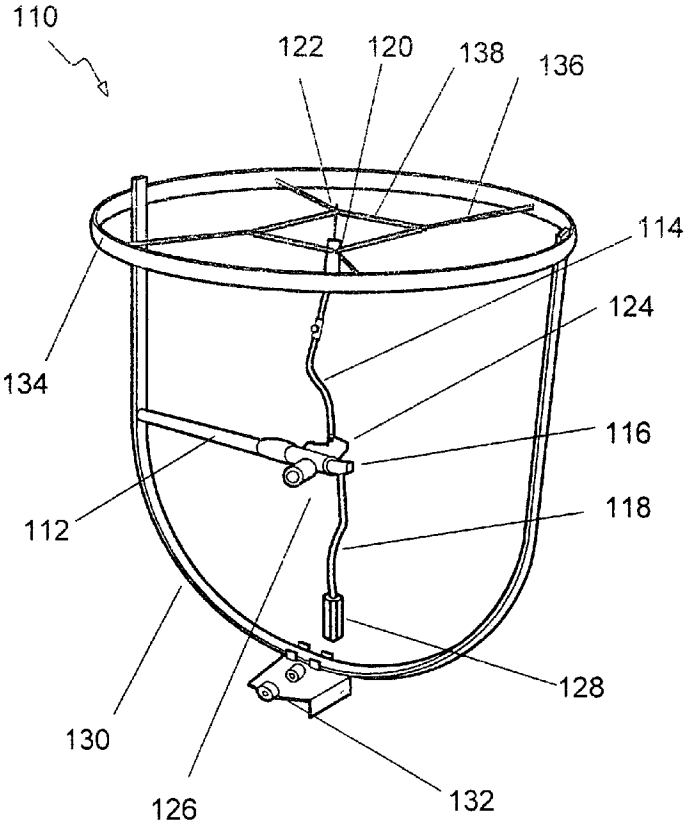
FIG. 4 is a photograph showing a perspective view of a prototype improved adjustable lawn sprinkler according to a first alternate embodiment of the present invention.
Figure 5:
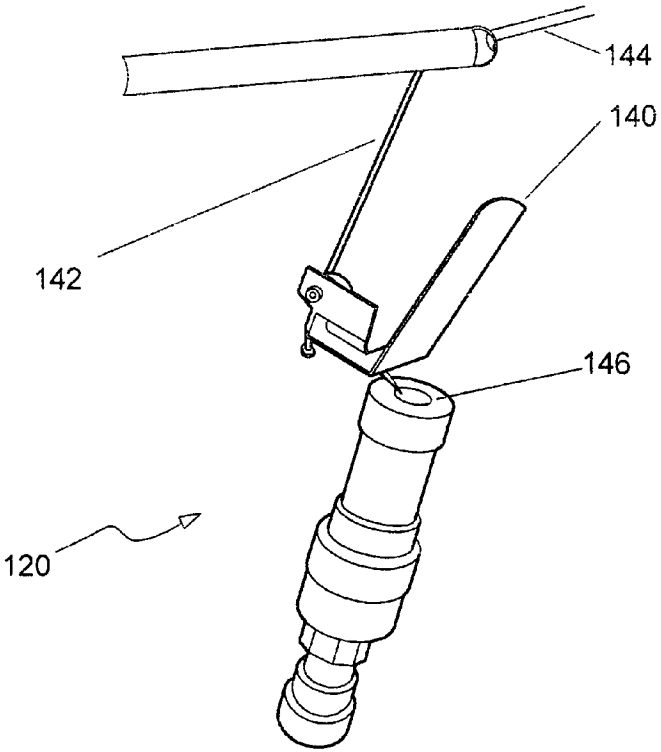
FIG. 5 is an enlarged perspective view of the nozzle, deflector, and elongated wire member of the first alternate embodiment of the present invention as shown in FIG. 4.
Figure 6:
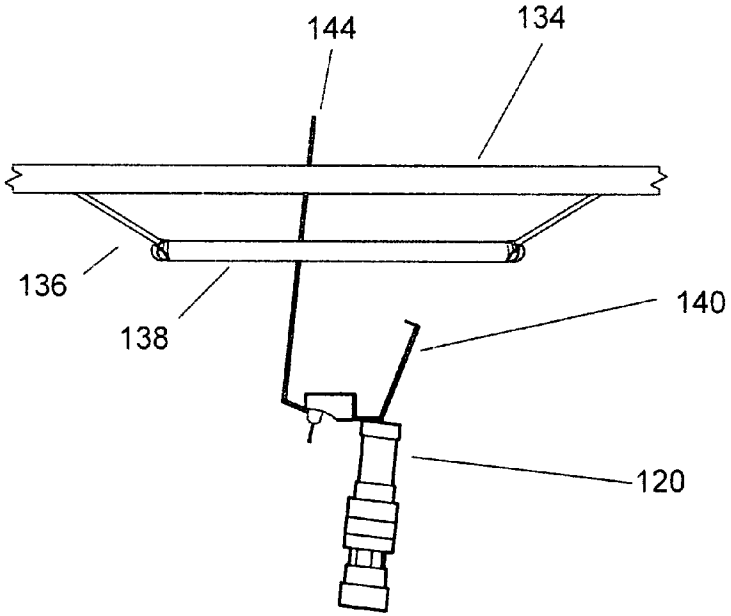
FIG. 6 is an enlarged perspective view of the nozzle, deflector, elongated wire member, guide member and barriers of the first alternate embodiment of the present invention as shown in FIG. 4.

Referring now to FIGS. 1-3, an improved adjustable lawn sprinkler 10 is provided according to the preferred embodiment of the present invention. The lawn sprinkler 10 has a counterbalanced rotating nozzle assembly 12 having a top portion 14, a middle portion 16 and a bottom portion 18. The top portion 14 of the nozzle assembly 12 has a nozzle 20 for producing a stream of water. According to the angle of the nozzle assembly 12, the nozzle 20 preferably dispenses the stream of water at an angle of approximately 45 degrees to approximately 90 degrees relative to the ground. The nozzle 20 has a central hole 21 and an annular opening 22 (through which the water flows). The middle portion 16 has a connecting mechanism 24 for connecting to a rotating mechanism 26 for allowing said nozzle assembly 12 to rotate. In one embodiment according to the present invention, the rotating mechanism 26, 24, 12 forms a universal joint which allows the counterbalanced nozzle assembly 12 to freely rotate about two axes when pressurized water is passed through the lawn sprinkler 10. The bottom portion 18 has a counterweight 28 for counterbalancing the weight of the nozzle 20 of the top portion 14. The rotating mechanism 26 is connected to a water transfer member 30 for providing water to the nozzle assembly 12. The water transfer member 30 can be generally tubular in design or be of any design that is conducive to transferring water. The water transfer member 30 is in fluid communication with a water inlet member 32 which provides water to the water transfer member 30.

The lawn sprinkler 10 further comprises a guide member 34 for releasably securing barriers 36. The guide member 34 can be mechanically fastened to the water transfer member 30 by any suitable fastener. The barriers 36 are aligned and positioned by a user to create a specific shape, with the specific shape directly corresponding to the area of a lawn that is to be irrigated by the water stream produced by the lawn sprinkler 10. The specific shape can be any shape that the user defines with the barriers 36. In one embodiment according to the present invention, the barriers 36 may be metal hooks, springs, rubber bands or the like. Further, the barrier 36 may be made of one continuous piece of material constructed in a predetermined shape, or a plurality of barriers 36 can be connected together to form any shape that a user desires for the purpose of irrigating that specific shape.

The nozzle 20 further comprises a deflector 40 for providing movement of the nozzle assembly 12 when the water stream comes into contact with the deflector 40. The deflector 40 is attached to an elongated wire member 42 having a connection to the deflector 44, a middle section 46, and a pivot section 45. It is anticipated that the middle section 46 of the wire member 42 comes into contact with the barriers 36 at any convenient location and within the user defined shape, and is curved to a specific formula. The middle section 46 is also offset. The pivot section 45 extends into the central hole 21 of the nozzle 20 and rotates freely within it.

Referring now to FIGS. 4-7, an exemplary prototype embodying a first alternate embodiment of the improved adjustable lawn sprinkler 110 is provided according to the preferred embodiment of the present invention. The lawn sprinkler 110 has a counterbalanced nozzle assembly 112 having a top portion 14, a middle portion 116 and a bottom portion 118. The top portion 114 of the nozzle assembly 112 has a nozzle 120 for producing a stream of water (not shown). The nozzle 120 preferably dispenses the stream of water at an angle of between approximately 45 degrees to approximately 90 degrees relative to the ground. The nozzle 120 has a central core (not shown) and an annular opening 122. The middle portion 116 has a connecting mechanism 124 for connecting to a pivoting rotational mechanism 126 for rotating said nozzle assembly 112. In this alternate embodiment, the rotating mechanism 126 forms directly opposite the attachment portion 152 of the first support structure 148. Further, the second support structure 150 is sealed so no water is transferred into the second support structure 150, and the water is forced from the water inlet member 132 to the receiving portion 154 of the first support structure 148. In this embodiment, the first and second support structures 148, 150 are rod shaped and have a semi-arcuate design. However, it is envisioned that the water transfer member 134, and first and second support structures 148, 150 can take on any shape that facilitates the transfer of water from the water inlet member 132 to the nozzle assembly 112. Further, a stake (not shown) can be provided for securing the lawn sprinkler 110 to the ground.

2. Operation of the Preferred Embodiment

Figure 7:
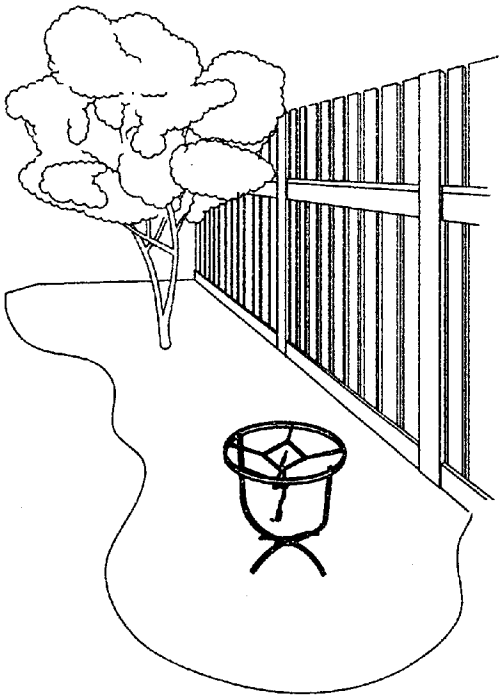
FIG. 7 is a perspective view of a lawn sprinkler according to the first alternate embodiment of the present invention as shown in FIG. 4, shown in use in a typical garden setting.
Figure 8:
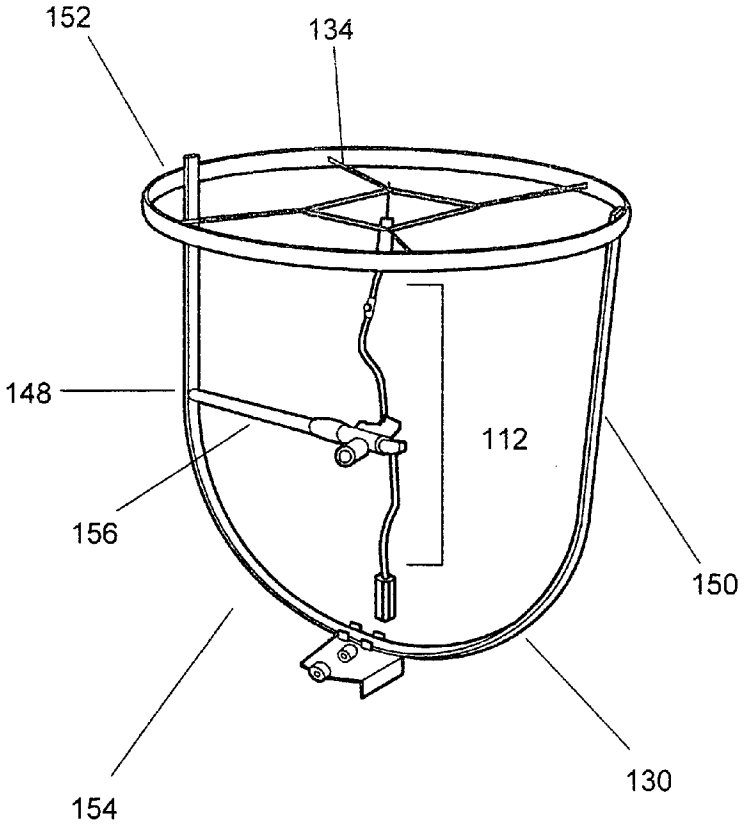
FIG. 8 is a photograph showing a perspective view of a prototype improved adjustable lawn sprinkler according to a second alternate embodiment of the present invention.

To use the present invention in accordance with a preferred embodiment of the present invention, as shown in FIG. 7, the lawn sprinkler is secured to the ground by a stake in a desirable location. The user then defines a specific shape to be irrigated by aligning and positioning the barriers in the specific shape. Once the specific shape is defined by the user, the user connects a fluid source, such as an outside faucet, to the water inlet member to propel the water through the water transfer member to the nozzle assembly. The water travels through the nozzle assembly passing through the central core and is dispensed from the nozzle through the annular opening as a single jet stream of water. The water contacts the deflector which causes the first and second ends of the elongated wire member and the nozzle assembly in which it is housed to move in a random direction. The curved middle section of the elongated wire continues to travel in that direction until it reaches the barrier which causes the wire member to rotate through approximately 90-180°, in turn causing the deflector, the wire member and the nozzle assembly to travel in a different, random direction. This process is repeated until all of the points within the user defined boundary have been irrigated by the lawn sprinkler. This allows the user to irrigate every point within any user defined area, with the curvature of the middle section of the we member ensuring that the pattern specified by the user-defined barrier is accurately reproduced in the spray pattern on the ground.

It is envisioned that a user defined area, specified by the placement of the barriers, having an area of approximately 20 square inches, would correspond to irrigating an approximately 800 square feet area of the lawn.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. An improved adjustable lawn sprinkler comprising:

a counterbalanced rotating nozzle assembly having a top portion, a middle portion and a bottom portion;

said top portion of the nozzle assembly having a nozzle for producing a stream of water and wherein according to an angle of the nozzle assembly, the nozzle dispenses the stream of water at an angle of between approximately 45 degrees to approximately 90 degrees relative to the ground;

said nozzle forming a central hole through which water flows;

said nozzle further forming an annular opening through which water flows;

said middle portion having a connecting mechanism for pivotally connecting to said nozzle assembly in a manner that allows said nozzle assembly to rotate;

said bottom portion having a counterweight for counterbalancing said nozzle;

a water transfer member in fluid communication through said connecting mechanism and to said nozzle assembly;

a guide member affixed to said water transfer member and generally circumscribing said upper portion and aligned and positioned by a user to create a specific shape, with the specific shape corresponding to the area of a lawn that is to be irrigated by the water stream produced by the lawn sprinkler, wherein said specific shape can be user defined through manipulation of the position of said barriers; and a plurality of barriers for impinging against said guide member, wherein said nozzle further comprises a deflector for providing movement of the nozzle assembly when a water stream comes into contact with the deflector, wherein said deflector is attached to an elongated wire member having a pivot section and connected at each end to the deflector and the middle section is connected to a pivoting mechanism, wherein when said middle section of the wire member comes into contact with the barriers within the user defined shape, and is curved to a specific formula.

2. The improved water sprinkler of claim 1, where said barriers are selected from the group consisting of metal hooks, springs, and rubber bands.

3. The improved water sprinkler of claim 1, wherein said barriers comprise continuous pieces of planar material constructed in a predetermined shape and connected together to form a shape that a user desires for the purpose of irrigating that specific shape.

4. The improved water sprinkler of claim 1, wherein said middle section is offset from said nozzle.

5. The improved water sprinkler of claim 1, wherein said pivot section extends into the central hole formed within the nozzle and is freely rotatable.

6. The improved water sprinkler of claim 1, wherein said water transfer member further comprises a support structure.

7. The improved water sprinkler of claim 6, wherein said support structure further comprises an attachment portion, a receiving portion and a transfer portion, wherein:

the attachment portion attaches to the guide member; and the receiving portion delivers water to the transfer portion which subsequently delivers water to the nozzle assembly;

said support structure being sealed above the transfer portion to force the water into the transfer portion.

8. The improved water sprinkler of claim 7, further comprising a stake for securing said support structure to a ground.

9. The improved water sprinkler of claim 1, wherein said connection mechanism further comprises a universal joint which allows the counterbalanced nozzle assembly to freely rotate in two axes when pressurized water is passed through the lawn sprinkler.

* * * * *